US006206736B1

(12) United States Patent
DeFrance et al.

(10) Patent No.: US 6,206,736 B1
(45) Date of Patent: Mar. 27, 2001

(54) ELECTRICAL CONDUCTOR SPLICING ASSEMBLY HAVING SPRING WITH OPPOSITE END PORTIONS CAPTURED BY AND INTERCONNECTING CONDUCTOR GRIPPING MEMBERS

(75) Inventors: Robert V. DeFrance, Poughkeepsie; Carl B. Nordstrom, deceased, late of Lake Katrine, both of NY (US), Elizabeth A. Nordstrom, administratrix

(73) Assignee: Hubbell Incorporated, Orange, CT (US)

( * ) Notice: Subject to any disclaimer, the term of this patent is extended or adjusted under 35 U.S.C. 154(b) by 0 days.

(21) Appl. No.: 09/427,106

(22) Filed: Oct. 26, 1999

(51) Int. Cl.[7] ..... H01R 11/09

(52) U.S. Cl. ..... 439/796

(58) Field of Search ..... 439/796, 723–725, 439/728, 733.1, 739, 794, 787, 799, 795, 786, 792, 788

(56) References Cited

U.S. PATENT DOCUMENTS

| | | | | |
|---|---|---|---|---|
| 1,657,253 | | 1/1928 | Fortin | 439/788 |
| 1,854,782 | | 4/1932 | Cook . | |
| 1,854,783 | | 4/1932 | Cook . | |
| 1,997,649 | | 4/1935 | Ohlund | 173/303 |
| 2,041,108 | | 5/1936 | Becker, Sr. et al. | 173/303 |
| 2,063,718 | | 12/1936 | Berndt | 173/303 |
| 2,078,051 | | 4/1937 | Berndt | 173/303 |
| 2,120,469 | | 6/1938 | Kyle | 24/126 |
| 2,128,832 | * | 8/1938 | Lusher | 403/303 |
| 2,144,050 | | 1/1939 | Fotsch | 24/126 |
| 2,166,458 | | 7/1939 | Berndt et al. | 174/94 |
| 2,434,358 | | 1/1948 | Frank | 174/84 |
| 2,521,722 | | 9/1950 | Hubbell et al. | 287/76 |
| 2,572,940 | | 10/1951 | Lockhart | 439/733 |
| 2,859,424 | | 11/1958 | Berndt | 339/248 |
| 3,166,373 | | 1/1965 | Berndt | 339/248 |
| 4,362,352 | | 12/1982 | Hawkins et al. | 339/248 |
| 5,082,456 | * | 1/1992 | Lan | 439/504 |
| 5,278,353 | * | 1/1994 | Buchholz et al. | 174/84 R |
| 5,980,284 | * | 11/1999 | Ho et al. | 439/159 |

* cited by examiner

*Primary Examiner*—Gary Paumen
*Assistant Examiner*—Phuong Chi Nguyen
(74) *Attorney, Agent, or Firm*—Michael R. Swartz

(57) ABSTRACT

An electrical conductor splicing assembly includes a tubular shell, and a pair of tubular gripping members and a spring disposed within an interior chamber of the shell. The shell and gripping members are electrically conductive. Each gripping member defines a longitudinal passageway and a cavity within an inner portion in communication with the passageway. The shell and gripping members receive an end of an electrical conductor through each opposite end portion of the shell and within each gripping member. The spring is disposed between the gripping members and has a main portion, a pair of opposite end portions and a pair of reduced diameter portions interconnecting the main portion to the opposite end portions. The opposite end portions of the spring are captured within the cavities of the gripping members. The reduced diameter portions of the spring are disposed adjacent to and extend away from the cavities of the gripping members. The main portion of the spring urges the gripping members away from one another outwardly toward the opposite end portions of the shell which have oppositely tapered configurations. The spring causes the gripping members to abut against the opposite end portions of the shell and press radially inwardly toward and grip the conductors inserted through the gripping members and thereby provide a splice-type electrical connection between the conductors via the gripping members and shell. The reduced diameter portions of the spring block the ends of the conductors from passing farther into the shell through the main portion of the spring located between the gripping members.

13 Claims, 2 Drawing Sheets

ELECTRICAL CONDUCTOR SPLICING ASSEMBLY HAVING SPRING WITH OPPOSITE END PORTIONS CAPTURED BY AND INTERCONNECTING CONDUCTOR GRIPPING MEMBERS

BACKGROUND OF THE INVENTION

1. Field of the Invention

The present invention generally relates to splicing devices for connecting electrical conductors and, more particularly, is concerned with an electrical conductor splicing assembly having a spring with opposite end portions captured by and interconnecting conductor gripping members.

2. Description of the Prior Art

Splicing devices are used to connect electrical conductors to one another. A variety of splicing devices are known in the prior art. Such splicing devices typically include a tubular shell, a plurality of conductor gripping members, one or more springs and one or more conductor stopping members. The shell may be one piece and have a pair of tapered opposite end portions. The gripping members are generally disposed within the shell. The one or more springs are generally interposed between and urge the gripping members outwardly toward the tapered opposite end portions of the shell causing the gripping members to grip the conductors inserted therethrough. The one or more stopping members may be disposed between or at opposite ends of the one or more springs to capture or block the ends of the conductors.

Representative examples of prior art splicing devices and the like are disclosed in U.S. Pat. No. 1,657,253 to Fortin, U.S. Pat. Nos. 1,854,782 and 1,854,783 to Cook, U.S. Pat. No. 1,997,649 to Ohlund, U.S. Pat. No. 2,041,108 to Becker, Sr., et al., U.S. Pat. Nos. 2,063,718 and 2,078,051 to Berndt, U.S. Pat. No. 2,120,469 to Kyle, U.S. Pat. No. 2,144,050 to Fotsch, U.S. Pat. No. 2,166,458 to Berndt et al., U.S. Pat. No. 2,434,358 to Frank, U.S. Pat. No. 2,521,722 to Hubbell et al., U.S. Pat. No. 2,572,940 to Lockhart, U.S. Pat. Nos. 2,859,424 and 3,166,373 to Berndt and U.S. Pat. No. 4,362,352 to Hawkins et al. While these prior art splicing devices may be satisfactory in use under the specific conditions for which they were designed, none of them seem to provide a simple and comprehensive solution for the splicing of electrical conductors.

Consequently, a need remains for further innovations which will provide an optimum solution for splicing electrical conductors without introducing any new problems that will replace those of the prior art.

SUMMARY OF THE INVENTION

The present invention provides an electrical conductor splicing assembly designed to satisfy the aforementioned need. The electrical conductor splicing assembly of the present invention includes a pair of conductor gripping members and a single spring disposed within a tubular shell. The spring has opposite end portions captured within cavities of the gripping members. The spring urges the gripping members away from one another and outwardly within tapered opposite end portions of the shell and causes the gripping members to grip electrical conductors inserted therethrough. The spring also has a pair of reduced diameter portions each disposed adjacent to one of the opposite end portions of the spring. The reduced diameter portions of the spring block the ends of the conductors from passing farther into the shell beyond the gripping members and toward one another. The combination of the spring and gripping members allows the shell to have a minimum length and the splicing assembly to have a minimum number of parts.

Accordingly, the present invention is directed to an electrical conductor splicing assembly which comprises: (a) a tubular shell made of a substantially electrically conductive material and having opposite ends, a middle portion and opposite end portions extending between the middle portion and opposite ends and tapering from the middle portion to the opposite ends, the shell defining an interior chamber open at the opposite ends of the shell; (b) a pair of tubular conductor gripping members made of a substantially electrically conductive material and disposed within the interior chamber of the shell, each of the gripping members having opposite inner and outer ends and defining a longitudinal passageway open at the inner and outer ends, the shell and gripping members being adapted for receiving an end portion of an electrical conductor through each of the opposite ends and within the interior chamber of the shell and through the outer end and within the passageway of each of the gripping members; and (c) a spring disposed within the interior chamber of the shell between the gripping members and having a main portion, a pair of opposite end portions and a pair of intermediate portions each disposed between and interconnecting one of the opposite end portions of the spring to the main portion thereof, the spring being mounted at the opposite end portions thereof to the inner ends of the gripping members and urging the gripping members away from one another outwardly toward the opposite ends of the shell and causing the gripping members to abut against the opposite end portions of the shell and press radially inwardly toward and grip the end portions of the electrical conductors received within the passageways and thereby provide an electrical connection between the electrical conductors via the gripping members and shell. The intermediate portions of the spring are disposed adjacent to the inner ends of the gripping members and are adapted to block the end portions of the electrical conductors from passing farther into the shell through the main portion of the spring located between the gripping members.

More particularly, the intermediate portions of the spring have diameters which are reduced in size relative to diameters of the opposite end portions of the spring. Further, the diameters of the intermediate portions of the spring are reduced in size relative to a diameter of the main portion of the spring. Each gripping member has an inner portion and an outer portion extending and tapering from the inner portion to the outer end of the gripping member. Each gripping member defines a cavity within the inner portion thereof in communication with the longitudinal passageway. The opposite end portions of the spring are captured within the cavities of the gripping members.

Each gripping member is internally threaded within the longitudinal passageway thereof adjacent to and interiorly of the outer end of the gripping member for gripping the end portion of the electrical conductor inserted into the longitudinal passageway of the gripping member. Each gripping member has a plurality of longitudinal slots spaced apart circumferentially from one another. Each slot extends interiorly from the outer end toward the inner end of the gripping member and is in communication with the longitudinal passageway of the gripping member. The longitudinal slots divide the gripping member into longitudinal segments which may be pressed radially inwardly toward one another for gripping the end portion of the electrical conductor inserted therebetween. One of the plurality of slots of each gripping member extends from the outer end to the inner end of the gripping member such that the gripping member may be pulled apart at the one slot for placing one of the opposite end portions of the spring within the cavity of the gripping member.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
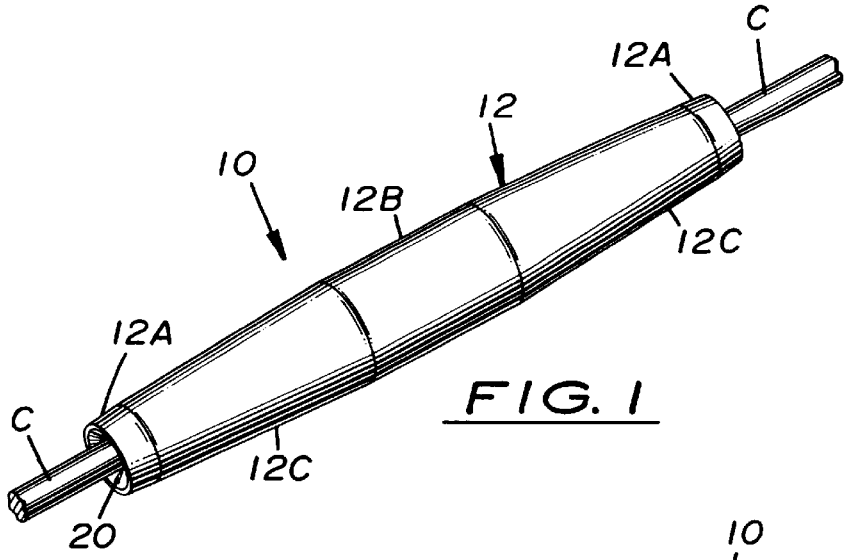
FIG. 1 is a perspective view of an electrical conductor splicing assembly of the present invention and opposite end portions of a pair of electrical conductors inserted through opposite ends of a tubular shell of the assembly.
Figure 2:
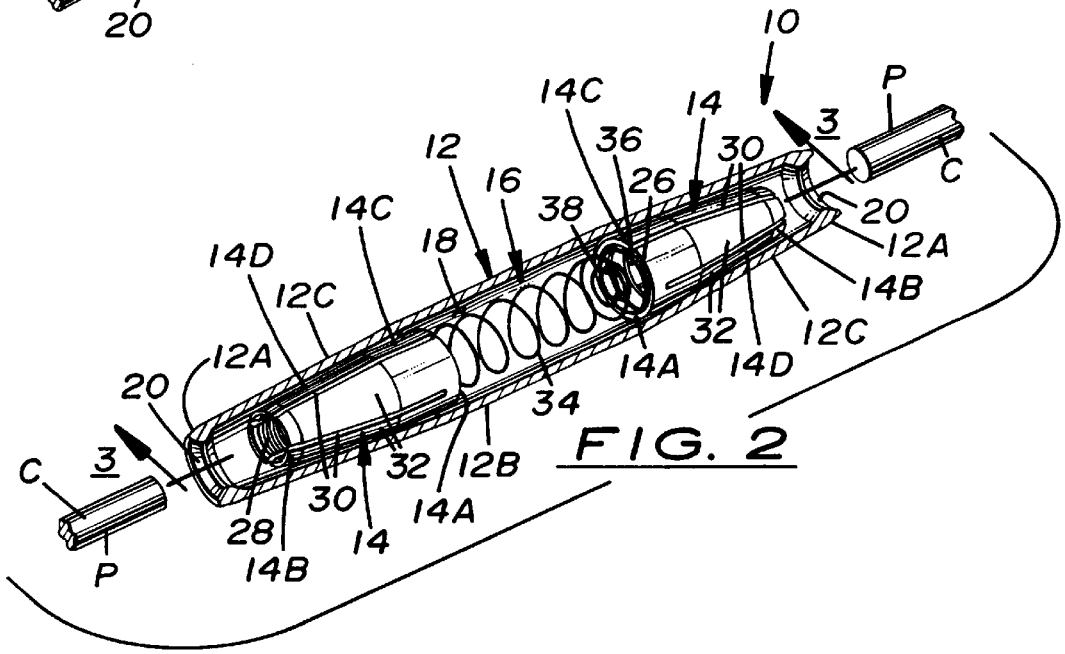
FIG. 2 is a perspective view of the electrical conductor splicing assembly similar to that of FIG. 1 but with the shell being longitudinally sectioned to show a pair of tubular conductor gripping members and a spring disposed within an interior chamber of the shell and with the opposite ends of the electrical conductors removed from the assembly.
Figure 3:
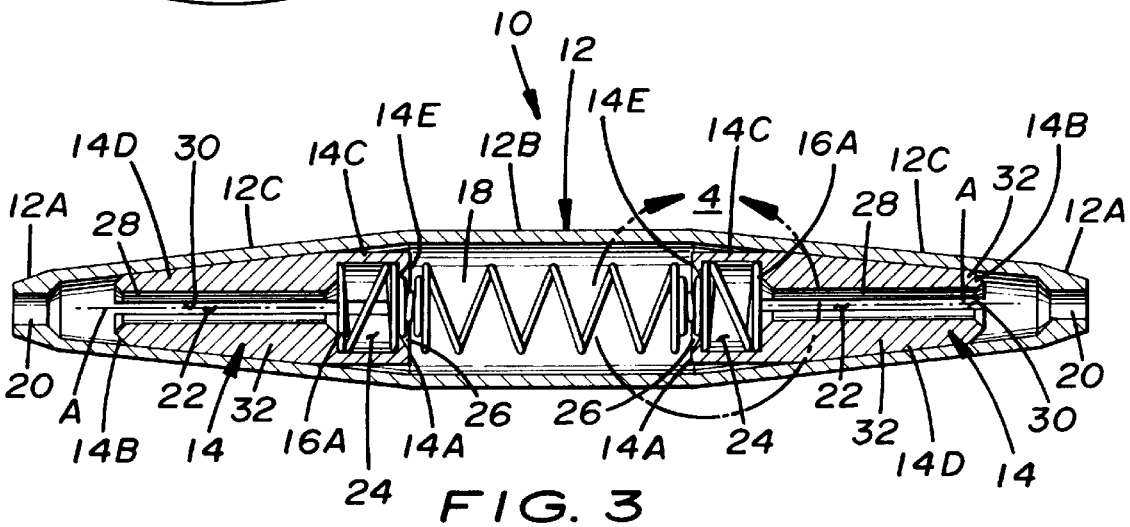
FIG. 3 is a longitudinal sectional view of the assembly taken along line 3—3 of FIG. 2.
Figure 4:
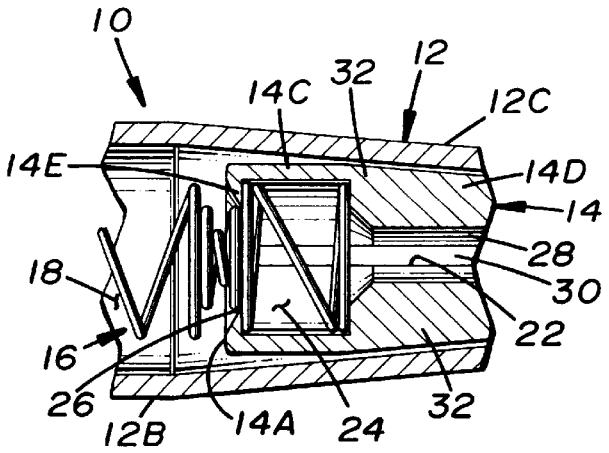
FIG. 4 is an enlarged detailed view of the portion of the assembly enclosed by circle 4 of FIG. 3.

Referring to the drawings and particularly to FIGS. 1 to 3, there is illustrated an electrical conductor splicing assembly, generally designated 10, of the present invention. The splicing assembly 10 is for providing an electrical connection between a pair of electrical conductors C. Each electrical conductor C is in the form of a copper wire or any other suitable type of conductor. The splicing assembly 10 basically includes a tubular shell 12, a pair of tubular conductor gripping members 14, and a spring 16. The tubular shell 12 and the gripping members 14 are made of a substantially electrically conductive material, such as copper or any other suitable material.

Referring now to FIGS. 1 to 5, the tubular shell 12 of the assembly 10 has a pair of opposite ends 12A, a middle portion 12B and a pair of opposite end portions 12C. The middle portion 12B has a substantially cylindrical configuration with a diameter substantially uniform along its length. The opposite end portions 12C extend in opposite directions from the middle portion 12B to the opposite ends 12A thereof. The opposite end portions 12C are substantially identical to one another and have a length greater than the length of the middle portion 12B. Each opposite end portion 12C has a diameter which gradually decreases from the larger diameter of the middle portion 12B to the smaller diameter of one of the opposite ends 12A.

The tubular shell 12 defines an interior chamber 18 open at the opposite ends 12A of the shell 12. The interior chamber 18 has a configuration defined by and thus substantially the same as the configurations of the middle portion 12B and the opposite end portions 12C of the shell 12. The interior chamber 18 has a length which is slightly less than the combined lengths of the middle portion 12B and the opposite end portions 12C. The shell 12 also defines a pair of end passages 20 each disposed at and extending interiorly through one of the opposite ends 12A of the shell 12 and in communication with the interior chamber 18. The end passages 20 have substantially circular configurations in transverse cross-section with the same diameter substantially uniform along their lengths. Each electrical conductor C has a diameter which is less than the diameter of the end passages 20 such that the electrical conductor C may be inserted therethrough.

Referring now to FIGS. 2 to 5, the tubular gripping members 14 of the assembly 10 are disposed within the interior chamber 18 of the shell 12. The gripping members 14 have substantially identical conical configurations which substantially conform to the tapered configurations of the opposite end portions 12C of the shell 12. Each gripping member 14 is disposed within one of the opposite end portions 12C of the shell 12 and has an axial length which is less than the length of one of the opposite end portions 12C of the shell 12. More particularly, each gripping member 14 has opposite inner and outer ends 14A, 14B, an inner portion 14C and an outer portion 14D. The inner portion 14C has a substantially cylindrical configuration and a diameter which is substantially uniform along its length and less than the diameter of one of the opposite end portions 12C of the shell 12 adjacent to the middle portion 12B of the shell 12. The outer portion 14D extends and tapers from the inner portion 14C to the outer end 14B. The outer portion 14D has an axial length which is greater than the axial length of the inner portion 14C. The outer portion 14D has a diameter which gradually decreases from the inner portion 14C to the outer end 14B. The gradually decreasing diameter of the outer portion 14D is less than that of one of the opposite end portions 12C of the shell 12 for most of the length of the one opposite end portion 12C. The diameter of the inner portion 14C, however, is greater than the gradually decreasing diameter of the one opposite end portion 12C of the shell 12 for most of the length of the one opposite end portion 12C such that the size of the inner portion 14C restricts movement of the gripping member 14 toward and at a point where the outer end 14B of the gripping member 14 is spaced from an adjacent opposite end 12A of the shell 12.

Each gripping member 14 defines a longitudinal passageway 22 open at the inner and outer ends 14A, 14B of the gripping member 14. More particularly, the longitudinal passageway 22 is defined within the outer portion 14D of the gripping member 14 and has a substantially circular configuration in transverse cross-section. The longitudinal passageway 22 is substantially aligned with the end passage 20 at the adjacent opposite end 12A of the shell 12. The axial length of the longitudinal passageway 22 is substantially the same as the length of the outer portion 14D. The diameter of the longitudinal passageway 22 is substantially uniform along its length and is less than the diameter of one of the end passages 20 of the shell 12. Each gripping member 14 defines a cavity 24 within the inner portion 14C in communication with the longitudinal passageway 22. The cavity 24 is open at the inner end 14A and to the longitudinal passageway 22. The cavity 24 has a substantially circular configuration in transverse cross-section. The length of the cavity 24 is slightly less than the length of the inner portion 14C. The diameter of the cavity 24 is substantially uniform along its length and is slightly less than the diameter of the inner portion 14C and is substantially greater than the diameter of the longitudinal passageway 22. Each gripping member 14 defines an inner end opening 26 disposed at the inner end 14A. The inner end opening 26 is formed by a circumferential lip 14E being beveled interiorly toward a central longitudinal axis A of the gripping member 14 and being open at and about the central longitudinal axis. The inner end opening 26 and lip 14E both have a substantially circular configuration. The inner end opening 26 has a diameter which is greater than the diameter of the longitudinal passageway 22 and the diameter of one of the end passages 20 of the shell 12.

Figure 5:
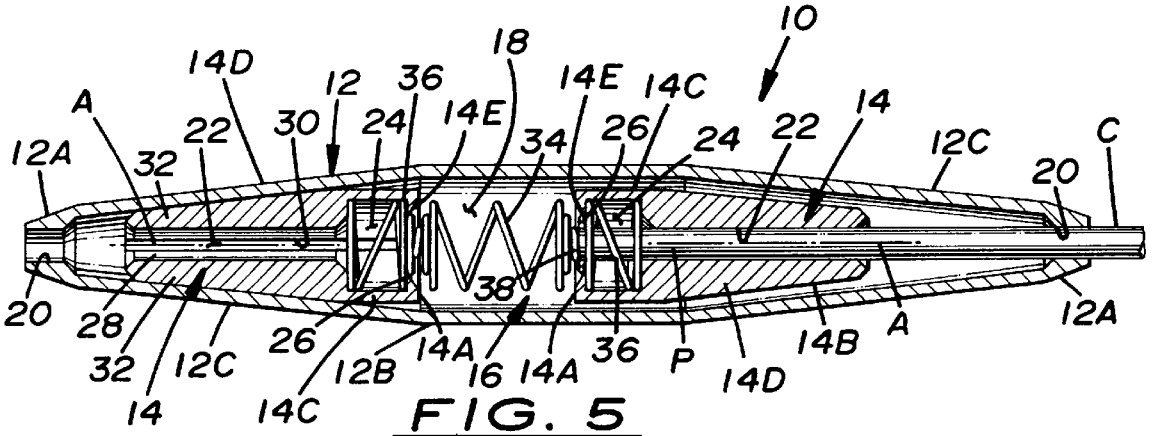
FIG. 5 is a longitudinal sectional view of the assembly similar to that of FIG. 3 but with the end portion of one electrical conductor received through one of the opposite ends and within the interior chamber of the shell and through an outer end and within a longitudinal passageway of one of the gripping members and being blocked by a reduced diameter portion of the spring from being inserted farther within the assembly.
Figure 6:
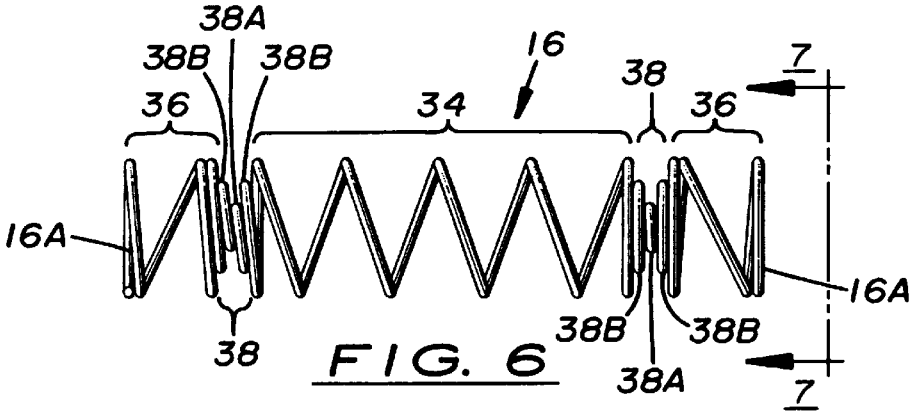
FIG. 6 is an enlarged elevational view of the spring of the assembly shown in FIGS. 2 to 5.
Figure 7:
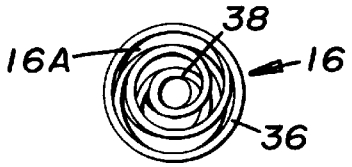
FIG. 7 is an end view of the spring as seen along line 7—7 of FIG. 6.

The end portion P of the electrical conductor C may be inserted through one of the end passages 20 and into the adjacent portion of the interior chamber 18 of the shell 12 and into the longitudinal passageway 22 and through the cavity 24 to the inner end 14A and into the inner end opening 26 of a gripping member 14. Each gripping member 14 can be internally threaded at 28 within the longitudinal passageway 22 adjacent to and interiorly of the outer end 14B of the gripping member 14 for gripping the end portion P of the electrical conductor C inserted into the longitudinal passageway 22 of the gripping member 14, as shown in FIG. 2. The internal threads 28 may extend any suitable distance into the longitudinal passageway 22. When the end portion P of the electrical conductor C is inserted into and through the passageway 22 of the gripping member 14, the outer portion 14D of the gripping member 14 may need to be somewhat expanded circumferentially as the diameter of the electrical conductor C may be somewhat greater than the diameter of the longitudinal passageway 22, as shown in FIG. 5. For permitting such expansion, each gripping member 14 has a plurality of longitudinal slots 30 spaced apart circumferentially from one another and each extending interiorly from the outer end 14B toward the inner end 14A and defined in communication with the longitudinal passageway 22 of the gripping member 14. Each gripping member 14, preferably, defines four longitudinal slots 30 which are spaced an equal distance apart from one another. Each of three of the slots 30 is defined completely through the outer portion 14D and partially through the inner portion 14C of the gripping member 14. One of the slots 30 extends from the outer end 14B to the inner end 14A and is defined completely through each of the outer portion 14D and the inner portion 14C of the gripping member 14. The slots 30 divide the gripping member 14 into longitudinal segments 32. Each segment 32 has a volume which is substantially the same as the volume of each of the other segments 32. The segments 32 may be pressed radially inwardly toward one another and toward the longitudinal passageway 22 of the gripping member 14 for gripping the electrical conductor C inserted therethrough. This segmentation of each gripping member 14 allows the outer portion 14D of the gripping member 14 to be deformed outwardly away from the central longitudinal axis A of the gripping member 14 when the end portion P of the electrical conductor C is inserted within the longitudinal passageway 22 and to be deformed inwardly toward the central longitudinal axis A when gripping the end portion P of the electrical conductor C. Since each of the segments 32 are substantially the same size, the force of the outer portion 14D of the gripping member 14 against the end portion P of the electrical conductor C is distributed evenly around a circumference thereof.

Referring now to FIGS. 2 to 7, the spring 16 of the assembly 10 is disposed within the interior chamber 18 of the shell 12 between the gripping members 14. The spring 16 is disposed mostly within the middle portion 12B and only partially within each of the opposite end portions 12C of the shell 12. The spring 16 is preferably a coil type. The spring 16 has a main portion 34, a pair of opposite end portions 36 and a pair of intermediate portions 38 each disposed between and interconnecting one of the opposite end portions 36 to the main portion 34. The intermediate portions 38, particularly, have reduced diameters, that is, their coils have diameters which are reduced in size relative to the diameters of the coils of the main portion 34 and of the opposite end portions 36. The spring 16 has a length greater than the length of the middle portion 12B of the shell 12 but less than the combined lengths of the middle portion 12B and the opposite end portions 12C of the shell 12. The coils of the opposite end portions 36 have diameters which are substantially the same as the diameters of the cavities 24 of the inner portions 14C of the gripping members 14.

The spring 16 is mounted at its opposite end portions 36 to the gripping members 14 adjacent to the inner ends 14A of the gripping members 14 with the opposite end portions 36 of the spring 16 being disposed and captured within the cavities 24 of the gripping members 14 defined by the inner portions 14C thereof. The opposite end portions 36 of the spring 16 are placed into the cavities 24 by pulling the gripping member 14 apart along the one longitudinal slot 30 which extends all the way through each of the outer and inner portions 14D, 14C of the gripping member 14. The spring 16 urges the gripping members 14 away from one another outwardly toward the opposite ends 12A of the shell 12 and causes the gripping members 14 to abut against the opposite end portions 12C of the shell 12 and press radially inwardly toward the central longitudinal axis A of the gripping members 14 and grip the end portions P of the electrical conductors C inserted therethrough and thereby provide an electrical connection between the electrical conductors C via the electrically conductive gripping members 14 and shell 12.

The intermediate, or reduced diameter, portions 38 of the spring 16 are disposed adjacent to and, particularly, are aligned with the inner ends 14A and are exteriorly of the inner end openings 26 of the gripping members 14. Each reduced diameter portion 38 has a middle coil 38A and a pair of opposite end coils 38B. The diameter of the middle coil 38A is less than the diameters of the opposite end coils 38B and less than the diameter of the end portion P of the electrical conductor C. The diameter of each of the opposite end coils 38B is greater than the diameter of the end portion P of the electrical conductor C and less than the diameter of the coils of the main portion 34 and opposite end portions 36 of the spring 16. The diameter of the coils of the opposite end portions 36 is greater than the diameter of the inner end opening 26 defined by the circumferential rim 14E of each of the gripping members 14 such that each of the opposite end portions 36 of the spring 16 are captured and retained within the cavities 24 of the gripping members 14. One of the opposite end coils 38B of each of the intermediate or reduced diameter portions 38 of the spring 16 is disposed just exteriorly of the inner end opening 26 and within the beveled portion of the inner end 14A of each of the gripping members 14. The middle coil 38A of each of the reduced diameter portions 38 of the spring 16 is disposed partially within the beveled portion and just exteriorly of the inner end 14A of each of the gripping members 14. Each reduced diameter portion 38 of the spring 16 blocks the end portion P of the given electrical conductor C and prevents its from passing farther into the shell 12 through the main portion 34 of the spring 16 located between the gripping members 14. The blocking of the end portions P of the electrical conductors C, particularly, occurs at the middle coil 38A of each reduced diameter portion 38 of the spring 16.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

We claim:

1. An electrical conductor splicing assembly, comprising:

(a) a tubular shell made of a substantially electrically conductive material and having opposite ends, a middle portion and opposite end portions extending between said middle portion and said opposite ends and tapering from said middle portion to said opposite ends, said shell defining an interior chamber open at said opposite ends of said shell;

(b) a pair of tubular conductor gripping members made of a substantially electrically conductive material and disposed within said interior chamber of said shell, each of said gripping members having opposite inner and outer ends and defining a longitudinal passageway open at said inner and outer ends, said shell and said gripping members being adapted for receiving an end portion of an electrical conductor through each of said opposite ends and within said interior chamber of said shell and through said outer end and within said passageway of each of said gripping members; and (c) a spring disposed within said interior chamber of said shell between said gripping members and having a main portion, a pair of opposite end portions and a pair of intermediate portions each disposed between and interconnecting one of said opposite end portions of said spring to said main portion thereof, said spring being mounted at said opposite end portions thereof to said inner ends of said gripping members and urging said gripping members away from one another outwardly toward said opposite ends of said shell and causing said gripping members to abut against said opposite end portions of said shell and press radially inwardly toward and grip the end portions of the electrical conductors received within said passageways and thereby provide an electrical connection between the electrical conductors via said gripping members and shell, said intermediate portions of said spring being disposed adjacent to said inner ends of said gripping members and having diameters which are reduced in size relative to diameters of said opposite end portions of said spring such that the end portions of the electrical conductors can pass through said opposite end portions of said spring whereas said intermediate portions of said spring are adapted to engage and thereby block the end portions of the electrical conductors from passing farther into said shell through said main portion of said spring located between said gripping members.

2. The assembly as recited in claim 1, wherein said intermediate portions of said spring have diameters which are reduced in size relative to a diameter of said main portion of said spring.

3. The assembly as recited in claim 1, wherein each of said opposite end portions of said shell has a length greater than a length of said middle portion of said shell.

4. The assembly as recited in claim 1 wherein each of said gripping members is internally threaded within said longitudinal passageway adjacent to and interiorly of said outer end of said gripping member for gripping the end portion of the electrical conductor inserted into said longitudinal passageway of said gripping member.

5. The assembly as recited in claim 1, wherein each of said gripping members has a plurality of longitudinal slots spaced apart circumferentially from one another each of said slots extending interiorly from said outer end toward said inner end and being in communication with said longitudinal passageway of said gripping member said longitudinal slots dividing said gripping member into longitudinal segments which may be pressed radially inwardly toward one another for gripping the end portion of the electrical conductor inserted therewithin and between said longitudinal segments.

6. The assembly as recited in claim 1, wherein each of said gripping members has an inner portion and an outer portion extending and tapering from said inner portion to said outer en d of said gripping member.

7. The assembly as recited in claim 6, wherein said outer portion of each of said gripping members has a length greater than a length of said inner portion of said gripping member.

8. An electrical conductor splicing assembly, comprising:

(a) a tubular shell made of a substantially electrically conductive material and having opposite ends, a middle portion and opposite end portions extending said middle portion and said opposite end portions and tapering from said middle portion to said opposite ends, said shell defining an interior chamber open at said opposite ends of said shell;

(b) a pair of tubular conductor gripping members made of a substantially electrically conductive material and disposed within said interior chamber of said shell, each of said gripping members having opposite inner and outer ends, an inner portion and an outer portion and defining a longitudinal passageway open at said inner and outer ends and a cavity within said inner portion in communication with said passageway, said shell and said gripping members being adapted for receiving an end portion of an electrical conductor through each of said opposite ends and within said interior chamber of said shell and through said outer end and within said passageway and said cavity of each of said gripping members; and (c) a spring disposed within said interior chamber of said shell between said gripping members and having a main portion, a pair of opposite end portions and a pair of intermediate portions each disposed between and interconnecting one of said opposite end portions of said spring to said main portion thereof, said opposite end portions of said spring being captured within said cavities of said gripping members so as to mount said spring to said gripping members such that said spring and said gripping members are connected together, said spring urging said gripping members away from one another outwardly toward said opposite ends of said shell and causing said outer portions of said gripping members to abut against said opposite end portions of said shell and press radially inwardly toward and grip the end portions of the electrical conductors received within said passageways and thereby provide an electrical connection between the electrical conductors via said gripping members and shell, said intermediate portions of said spring being disposed adjacent to said inner ends of said gripping members and having diameters which are reduced in size relative to diameters of said opposite end portions of said spring such that the end portions of the electrical conductors can pass through said opposite end portions of said spring whereas said intermediate portions of said spring are adapted to engage and thereby block the end portions of the electrical conductors from passing farther into said shell through said main portion of said spring located between said gripping members.

9. The assembly as recited in claim 8, wherein said outer portion of each of said gripping members extends and tapers from said inner portion to said outer end of said gripping member.

10. The assembly as recited in claim 8, wherein each of said gripping members is internally threaded within said longitudinal passageway adjacent to and interiorly of said outer end of said gripping member for gripping the end portion of the electrical conductor inserted into said longitudinal passageway of said gripping member.

11. The assembly as recited in claim 8, wherein said inner ends of said gripping members each have an inwardly projecting lip forming an opening having a diameter less than the diameter of said corresponding cavity in said inner portion of said gripping member, said opposite end portions of said spring being disposed within said cavities of said gripping members and captured therewithin by said lips such that said spring and said gripping members are connected together.

12. The assembly as recited in claim 8, wherein each of said gripping members has a plurality of longitudinal slots spaced apart circumferentially from one another, each of said slots extending interiorly from said outer end toward said inner end and being in communication with said longitudinal passageway of said gripping member, said longitudinal slots dividing said gripping member into longitudinal segments which may be pressed radially inwardly toward one another for gripping the end portion of the electrical conductor inserted therewithin and between said longitudinal segments.

13. The assembly as recited in claim 12, wherein one of said plurality of slots of each of said gripping members extends from said outer end to said inner end of said gripping member such that said gripping member may be pulled apart at said one slot for placing one of said opposite end portions of said spring within said cavity of said gripping member.

* * * * *